US007398583B2

(12) United States Patent
Watzl

(10) Patent No.: US 7,398,583 B2
(45) Date of Patent: Jul. 15, 2008

(54) PROCESS FOR HYDRODYNAMIC INCLUSION OF A MULTITUDE OF THREE-DIMENSIONAL PRODUCTS OF FINITE DIMENSIONS BY WATER JETS

(75) Inventor: Alfred Watzl, Rodermark (DE)

(73) Assignee: Fleissner GmbH, Egelsbach (DE)

( * ) Notice: Subject to any disclaimer, the term of this patent is extended or adjusted under 35 U.S.C. 154(b) by 307 days.

(21) Appl. No.: 10/536,722

(22) PCT Filed: Nov. 21, 2003

(86) PCT No.: PCT/EP03/50862

§ 371 (c)(1),
(2), (4) Date: May 27, 2005

(87) PCT Pub. No.: WO2004/050977

PCT Pub. Date: Jun. 17, 2004

(65) Prior Publication Data

US 2006/0064858 A1 Mar. 30, 2006

(30) Foreign Application Priority Data

Nov. 29, 2002 (DE) ..... 102 56 138

(51) Int. Cl.
*D04H 1/46* (2006.01)

(52) U.S. Cl. ..... 28/104

(58) Field of Classification Search ..... 28/104, 28/105, 167, 106, 107, 109, 103, 158; 442/381, 442/384, 385, 387, 408
See application file for complete search history.

(56) References Cited

U.S. PATENT DOCUMENTS

| | | | | |
|---|---|---|---|---|
| 3,508,308 | A | 4/1970 | Bunting, Jr. et al. | |
| 4,808,467 | A * | 2/1989 | Suskind et al. | 442/384 |
| 5,153,056 | A * | 10/1992 | Groshens | 442/150 |
| 6,177,370 | B1 * | 1/2001 | Skoog et al. | 442/387 |
| 6,314,627 | B1 * | 11/2001 | Ngai | 28/104 |
| 6,460,233 | B2 * | 10/2002 | Noelle | 28/104 |
| 6,842,953 | B2 * | 1/2005 | Orlandi | 28/104 |
| 2005/0071966 | A1 * | 4/2005 | Barth et al. | 28/104 |

FOREIGN PATENT DOCUMENTS

| | | |
|---|---|---|
| WO | WO 00/63479 | 10/2000 |
| WO | WO 02/052083 | 7/2002 |

* cited by examiner

*Primary Examiner*—Amy B Vanatta
(74) *Attorney, Agent, or Firm*—Antonelli, Terry, Stout & Kraus, LLP.

(57) ABSTRACT

Finite goods are continuously packed between two non-wovens by means of hydrodynamic needling and are fully sealed. When used, said wovens should not nap and should not become linked to the goods during packing. When packed, the volume of the goods should, wherever possible, remain unchanged. In order to achieve said aims, the covering non-wovens are prefixed by means of hydrodynamic needling. Particularly good results are achieved if perforated non-wovens are used to cover the finite products, the number of said perforations being approximately 5-20 perforations per inch, and when said non-wovens are joined to each other by means of water needling.

12 Claims, No Drawings

PROCESS FOR HYDRODYNAMIC INCLUSION OF A MULTITUDE OF THREE-DIMENSIONAL PRODUCTS OF FINITE DIMENSIONS BY WATER JETS

It is known from WO 00/63479 to deposit three-dimensional goods such as also initial or intermediate products between two material webs such as nonwovens, to join the nonwovens by felting their fibres as a result of hydrodynamic needling, consolidating and thereby also include the goods.

As long as the consolidation process is to take place continuously over the length of the advancing sandwich web, regardless of whether the three-dimensional goods run parallel to the direction of transport of the material web or perpendicular thereto, there is no difference from the previously known consolidation method using needling according to U.S. Pat. No. 3,508,308, for example. However, if the goods are of finite dimensions and are to be packed and fully sealed, the goods can only be consolidated or packed in partially over the surface using the previously known method with continuous water needling.

It is the object of the invention to find a method with which such finite goods such as pre-fabricated padding and/or absorbent inserts for nappies, wound dressings, compresses, cushions, possibly also plasters or similar finished products can be continuously packaged without the products inadmissibly losing any volume and the covering nonwovens becoming linked to the products during the packaging needling.

Starting from a method for hydrodynamic inclusion of a layer comprising a plurality of three-dimensional finite products of at least two, in some cases three or more nonwovens, tissue, possibly additional woven fabrics or knitted fabrics by means of liquid jets emerging continuously and uniformly over a working width from a nozzle bar, by spraying a liquid under pressure from fine nozzle openings arranged in a row from at least one nozzle strip extending over the working width of at least one nozzle bar towards the material web which is moving ahead of the nozzle bar, the invention consists in the fact that a nonwoven which subsequently covers the middle layer is initially consolidated over the entire surface using water jets, the middle layer to be included, the finite three-dimensional material to be applied thereto, is laid on this consolidated nonwoven, these two layers are then covered with a further nonwoven which has been prefixed in the same way and everything together is again subject to hydrodynamic needling uniformly over the working width to join the two superimposed covering nonwovens together.

The desire to continuously package such products which are three-dimensional in height and have sensitive product characteristics is thereby met. The pre-fixed covering nonwovens have a density, bearing capacity and strength which does not disadvantageously influence the products after joining the covering nonwovens by means of hydrodynamic needling. The products can remain voluminous and in particular do not link to the surface of the nonwoven which has already consolidated in the structure of the nonwoven. It is particularly advantageous that the covering nonwovens have their own strength and do not nap when used, i.e. they have sufficient abrasion strength.

All this particularly applies if the prefixed nonwovens are provided with a perforated structure during consolidation, which is formed if the hydrodynamic consolidation is carried out with a hole spacing of 5-20 hpi in the nozzle strip and a water pressure of at least 100 bar. Good binding-in of the fibres of the covering nonwovens is thereby achieved. If these nonwovens prefixed in this way are placed one above the other and the products of finite dimensions are provided therebetween, and the nonwovens are further joined to form the final packaging of the products preferably also using a nozzle bar having nozzle strips provided with 5-20 hpi holes and the water pressure is no higher than 200 bar, the fibres of the covering nonwovens then join together and become entangled in the areas around the products but the products remains substantially unchanged in volume and at least do not link to the nonwovens during the packaging water needling.

The invention claimed is:

1. A method for hydrodynamic inclusion of a layer comprising a plurality of three-dimensional finite products between at least two nonwovens comprising:

providing a first nonwoven fabric;

consolidating the first nonwoven fabric with liquid jets emerging continuously and uniformly over a working width of a nozzle bar, by spraying a liquid under pressure from fine nozzle openings arranged in a row from at least one nozzle strip extending over the working width of at least one nozzle bar towards the first nonwoven fabric which is moving ahead of the nozzle bar such that the first nonwoven fabric is initially consolidated over its entire surface using water jets;

laying a plurality three-dimensional finite products on the consolidated first nonwoven fabric;

covering the plurality of three-dimensional finite products with a second nonwoven fabric which has been consolidated over its entire surface using water jets to provide a composite comprising the first nonwoven fabric which has been consolidated over its entire surface, the plurality of three-dimensional finite products and the second nonwoven fabric which has been consolidated over its entire surface; and subjecting the composite to hydrodynamic needling uniformly over its working width to join the first and second nonwoven fabrics together.

2. The method according to claim 1, characerised in that each of the first and second nonwoven fabrics is perforated with fine holes produced by the water jets.

3. The method according to claim 2, characterised in that a number of water jets which impacts on at least the first nonwoven fabric from the nozzle bar is about 5-20 jets per inch.

4. The method according to claim 3, characterised in that a water pressure during the perforating and consolidation of the first nonwoven fabric is about 100 to 200 bar.

5. The method according to claim 1, characterised in that the subjecting of composite to hydrodynamic needling uniformly over its working width to join the first and second nonwoven fabrics together takes place using water jets which impact on the composite with a spacing of about 5-20 jets per inch.

6. The method according to claim 5, characterised in that the water pressure when subjecting of composite to hydrodynamic needling uniformly over its working width to join the first and second nonwoven fabrics together is between 100 and 200 bar.

7. The method according to claim 1, characterised in that each of the first and second nonwoven fabrics is needled on both sides for consolidation.

8. The method according to claim 3, characterised in that a number of water jets which impacts on at least the first nonwoven fabric from the nozzle bar is about 10 jets per inch.

9. The method according to claim 4, characterised in that a water pressure during the perforating and consolidation of the first nonwoven fabric is about 150 bar.

10. The method according to claim 5, characterised in that the subjecting of composite to hydrodynamic needling uniformly over its working width to join the first and second nonwoven fabrics together takes place using water jets which impact on the composite with a spacing of about 10 jets per inch.

11. The method according to claim 6, characterised in that the water pressure when subjecting of composite to hydrodynamic needling uniformly over its working width to join the first and second nonwoven fabrics together is 120 to 150 bar.

12. The method according to claim 1, characterised in that the plurality of three-dimensional finite products comprise a plurality of products selected from the group consisting of padding, absorbent inserts, wound dressings, compresses, cushions and plasters.

* * * * *